United States Patent [19]

Cheah et al.

[11] Patent Number: 5,066,901

[45] Date of Patent: Nov. 19, 1991

[54] TRANSIENT PROTECTED ISOLATOR OUTPUT STAGE

[75] Inventors: Chun-Foong Cheah, Sunnyvale; Timothy J. Skovmand, San Jose, both of Calif.

[73] Assignee: National Semiconductor Corporation, Santa Clara, Calif.

[21] Appl. No.: 584,568

[22] Filed: Sep. 18, 1990

[51] Int. Cl.[5] ..... G05F 3/30; G05F 1/565

[52] U.S. Cl. ..... 323/267; 323/275; 323/277; 323/908

[58] Field of Search ..... 323/267, 275, 276, 277, 323/278, 280, 908, 314, 316

[56] References Cited

U.S. PATENT DOCUMENTS 3,527,997 9/1970 Nercessian ..... 323/277

3,796,943 3/1974 Nelson et al. ..... 323/277

4,731,574 3/1988 Melbert ..... 323/908

*Primary Examiner*—Peter S. Wong

*Attorney, Agent, or Firm*—Gail W. Woodward; Michael A. Glenn; James W. Rose

[57] ABSTRACT

An automotive voltage regulator is disclosed to have plural regulated outputs using a transient protected isolator output stage (TPIOS) that prevents a system fault condition on any one output from adversely affecting the other outputs. In an automotive environment employing a nominal 14-volt supply, an individual output can be taken from −4 to +26 volts without causing damage or having any significant reaction on the non-faulted outputs. The circuit employs a relatively small NPN output pass transistor and, therefore, requires a relatively low value stabilizing bypass capacitor.

9 Claims, 2 Drawing Sheets

TRANSIENT PROTECTED ISOLATOR OUTPUT STAGE

BACKGROUND OF THE INVENTION

The invention relates to voltage regulators, particularly those intended for use in automotive applications. Under certain conditions, an automotive voltage regulator will be required to provide a plurality of outputs so that several independent devices can be supplied with a regulated voltage. These outputs each employ an isolator stage that permits independent or isolated load supplies. One of the main characteristics of an automotive system is the propensity of various parts of the chassis ground to assume different potentials. This is a well known fact of life in the automotive world. The various chassis grounds can develop as much as a +4-volt differential. Thus, when an output becomes shorted to ground, it can be as low as −4 volts. Another problem can develop where the regulator output becomes shorted to a higher than normal positive potential. For example, as much as 26 volts can inadvertently become associated with the output terminal. As a result, the automotive voltage regulator outputs under adverse conditions can be subjected to voltages that may vary from +26 volts to −4 volts. It is desired that the regulator survive such extremes without damage and that for plural outputs the fault conditions applied to one output will not adversely affect the other outputs.

Another voltage regulator characteristic involves its output impedance. If the circuit pass transistor is of PNP polarity, as is often the case, the collector is connected to the output terminal. This is the high impedance transistor element and this connection produces an instability that requires a relatively large bypass capacitor as a cure. This condition is presented in detail in a U.S. Pat. No. 4,928,056, by Robert A. Pease. This patent is titled A STABILIZED LOW-DROPOUT VOLTAGE REGULATOR CIRCUIT, issued May 22, 1990, and is assigned to the assignee of the present invention. The teaching in this patent is incorporated herein by reference. Typically, the use of a PNP output pass transistor will require a minimum of ten microfarads bypass capacitance. Preferably a tantalum capacitor is employed. In the present invention, an NPN output pass transistor is employed which requires that the low impedance emitter terminal be connected to the output terminal. This configuration permits the use of a relatively small 0.06 microfarad capacitor. While the use of a small capacitor is not of much economic significance in a single voltage regulator, a plural output device can require the use of several relatively costly capacitors. This can be significant.

As a further consideration, when the voltage regulator is fabricated in the form of a monolithic integrated circuit (IC), the chip area is substantially taken up by the output pass transistor. When using an NPN type of output pass transistor, we have found that much less chip area is required as opposed to using a PNP type. Therefore, the invention also produces an IC area economy.

SUMMARY OF THE INVENTION

It is an object of the invention to provide a voltage regulator having a plurality of isolated output stages that can provide a plurality of regulated voltage sources operated in common from a single reference source and substantially isolated from each other.

It is a further object of the invention to provide a voltage regulator output stage that can withstand, without damage, load transients that rise substantially above the regulated output and fall substantially below ground.

It is a still further object of the invention to employ a monolithic IC form of construction and employs an NPN output pass transistor to produce a chip area economy and to reduce the size of stabilizing shunt capacitors.

These and other objects are achieved in a circuit configured as follows. The regulator circuit includes a reference voltage generator that develops a temperature compensated source of constant potential. The source commonly operates a plurality of transient-protected isolator output stage (TPIOS) circuits, each of which produces a separate regulated voltage. Each TPIOS circuit includes an NPN pass transistor whose conduction is controlled by a high gain negative feedback loop that is operated to control the output with respect to the source of reference voltage. Each TPIOS circuit also includes means for permitting the output terminal to be pulled substantially below ground as well as substantially above the vehicle supply voltage without producing any excess stress on the circuit elements.

Furthermore, the NPN output pass transistor dedicates the emitter of the power transistor to be connected to the output terminal. This low impedance connection stabilizes the voltage regulator which permits the use of a relatively small by pass capacitor.

DESCRIPTION OF THE PRIOR ART

Figure 1:
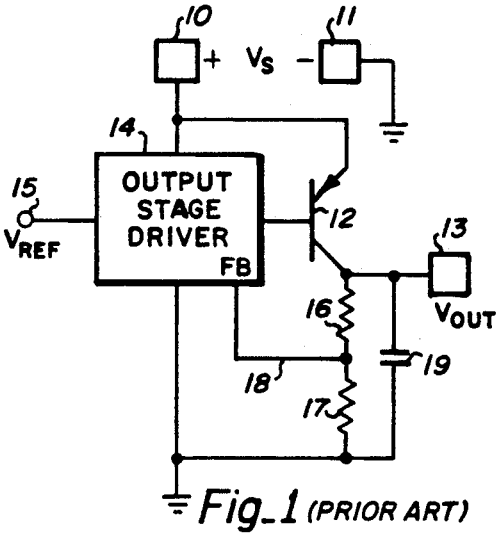
Fig 1 (PRIOR ART)
FIG. 1 is a block-schematic diagram of a conventional prior art device using a PNP output pass transistor.

FIG. 1 illustrates a typical prior art voltage regulator. The circuit operates from a $V_S$ power supply (typically the automotive battery and its charging source) connected + to terminal 10 and − to ground terminal 11. A large-area power PNP transistor 12 couples terminal 10 to output terminal 13 which provides a regulated potential. Typically, terminal 13 is at about 8 volts. The base of transistor 12 is driven from a circuit 14 that is supplied with a temperature stabilized voltage obtained by well known circuitry and applied to reference terminal 15. Resistors 16 and 17 form a voltage divider that applies a feedback voltage, that represents a fraction of the regulated output voltage, to the driver circuits on line. It will be noted that the collector of transistor 12 is connected to output terminal 13. Since this electrode represents a high impedance node, bypass capacitor 19 must have a substantial value to provide a low power supply terminal impedance. Typically, capacitor 19 will be a ten microfarad tantalum capacitor which has a suitably low impedance at conventional power line frequencies.

It will be noted that if terminal 13 is pulled low, due to some system malfunction, the feedback to driver 14 will be disrupted. This can, if the driver 14 pulls the base of transistor 12 low, produce catastrophic excess power transistor dissipation. Furthermore, if terminal 13 is pulled higher than $V_S$, by virtue of a system malfunction, it can be seen that the collector transistor 12 will assume the role of emitter. Since such PNP transistors are typically of lateral construction, the device can operate well in this inverted state. Since the driver circuits operate the base at a potential that is close to $V_S$, transistor 12 will conduct heavily and pass a possibly catastrophic current. At the same time, the parasitic transistor formed between transistor 12 and the IC substrate will conduct heavily and thus, a large substrate current will flow. As a result of the above, the circuit of FIG. 1 is regarded as prone to failure due to system malfunctions.

DESCRIPTION OF THE INVENTION

Figure 2:
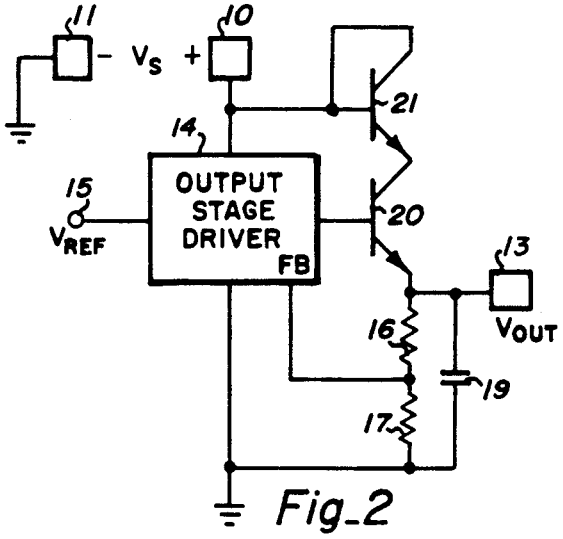
FIG. 2 is a block-schematic diagram of the basic circuit of the invention.

FIG. 2 is a block-schematic diagram similar to that of FIG. 1, but showing the core of the invention. A TPIOS is disclosed. Where the same elements are involved, the same numerals are employed. NPN transistor 20 is the output pass element and an equal size transistor 21 is diode connected and coupled in series with transistor 20. For an equal output current capability transistor 20 needs only to be about one-third the area of the PNP transistor 12 of FIG. 1. Thus, the combined areas of NPN transistors 20 and 21 is still only two-thirds of the area of the PNP transistor and a significant IC chip area saving is afforded. Since output terminal 13 is fed from the emitter of the pass transistor 20, the circuit presents a low impedance and is, therefore, inherently stable. While capacitor 19 of FIG. 1 is ten microfarads (minimum), for the same rated output, capacitor 22 of FIG. 2 can be as low as about 0.06 microfarad or 167 times smaller.

If terminal 13 is pulled high, due to a system malfunction, it can be seen that, unlike the lateral PNP transistor, the NPN pass transistor 20 will not function effectively in the inverted state. Transistor 21 is included in the circuit for the purpose of preventing zener diode conduction when terminal 13 is raised to more than the zener voltage of transistor 20 above the $V_S$ potential. Therefore, there will be little chance of a destructive current even with a high over potential.

Finally, if terminal 13 is pulled below ground, by virtue of an adverse system malfunction, it can be seen that the feedback to driver 14 is also pulled down. Circuitry is incorporated in driver 14 to reduce the conduction in transistor 20. This action will be described in more detail subsequently. Accordingly, such malfunctions will not result in excessive conduction in the pass transistor.

Figure 3:
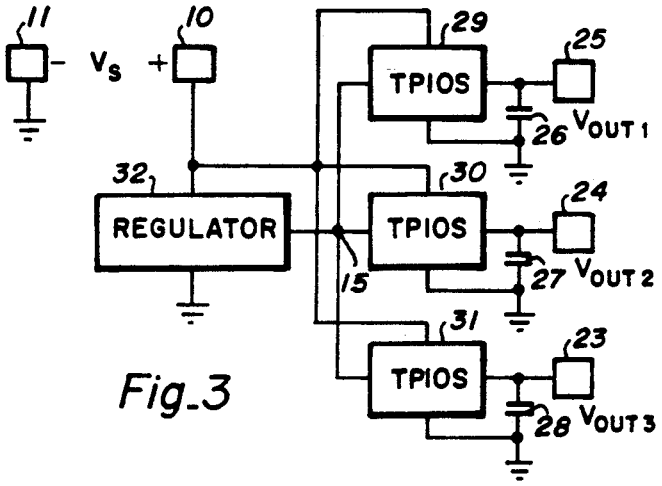
FIG. 3 is a block diagram of an automotive plural output voltage regulator.

FIG. 3 is a block diagram of an automotive application of the invention where plural TPIOS circuits are operated from one regulator which produces a temperature invariant $V_{REF}$. It can be seen that the device provides those regulated output voltages at terminals 23–25. Clearly, additional outputs could be employed, if desired. It is important that when one output is upset by a system malfunction, the other outputs will not be affected. The three outputs shown each include three small bypass capacitors 26–28 and are supplied respectively by TPIOS circuits 29–31. A single reference generator 32 provides a temperature stabilized reference voltage at node 15 for the three TPIOS output stages. In the preferred embodiment to be described, the output voltages and $V_{REF}$ are at 8 volts. For a nominal 14 volt power supply, which represents a fully charged vehicle batter, the three 8-volt outputs can be employed to provide service for three independent functions. Each output can be pulled between +26 and 31 4 volts without having any adverse effect upon the other outputs. Even under such a system malfunction, the affected circuit will not sustain damage.

Figure 4:
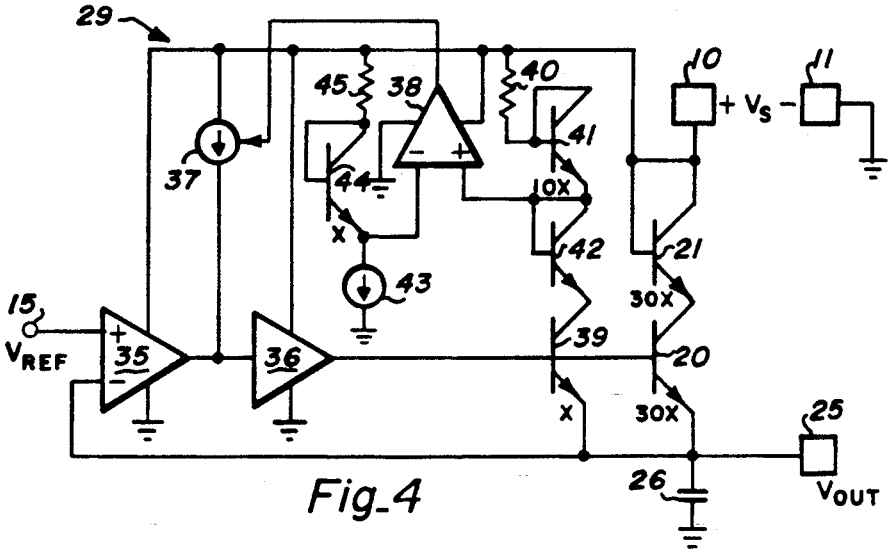
FIG. 4 is a block-schematic diagram of a TPIOS in accordance with the invention.

FIG. 4 is a detailed block diagram of a TPIOS circuit. By way of example, block 29 of FIG. 3 is detailed. As was indicated above, NPN output transistor 20 is coupled in series with an equivalent transistor 21, that is diode connected, between the supply terminal 10 and output terminal 25. Thus, transistors 20 and 21 constitute the output pass element.

Diff-amp 35 and buffer 36 form a negative feedback loop around the emitter-base circuit of transistor 20 whereby a regulated output at terminal 25 is maintained. The regulated output is coupled to the inverting input of diff-amp 35 and $V_{REF}$ from terminal 15 is coupled to the noninverting input. Thus, diff-amp 35 will drive the base of transistor 20, via buffer 36, until the potential at the emitter of transistor 20 matches $V_{REF}$ and is regulated against changes in load current as well as line input voltage. This high gain feedback loop ensures that the output voltage closely matches $V_{REF}$ under ordinary operating conditions.

If no other circuit functions were present, a system malfunction that would pull terminal 25 below ground could result in excessive and potentially damaging current in transistors 20 and 21. However, a secondary feedback loop is incorporated to prevent such a condition.

It will be noted that the output of diff-amp 35 is supplied by a variable current source 37 which, under certain conditions that will be described below, can provide the input to buffer 36. Diff-amp 38 comprises the heart of the secondary feedback loop. Its output controls the current in source 37. The noninverting input of diff-amp 38 is driven from transistor 39 whose base to emitter circuit is in parallel with that of transistor 20. However, since transistor 39 has an area of 1/30 of that of transistor 20, it will only conduct 1/30 of the stage 29 output current. The current drawn by transistor 39 is pulled through resistor 40 and diode-connected transistors 41 and 42. Thus, the noninverting input to diff-amp 38 is the voltage drop across resistor 40 and diode-connected transistor 41 below $V_S$. The inverting input of diff-amp 38 is directly coupled to a reference circuit that is operated by constant current sink 43 which pulls current through diode-connected transistor 44 and resistor 45. Thus, the inverting input of diff-amp 38 is below $V_S$ by the voltage drop across resistor 45 and diode-connected transistor 44. Current sink 43 is made to conduct a current that is slightly greater than the nominal current flowing in source 37. Thus, the output of diff-amp 38 under quiescent conditions will, via current source 37, produce a current input to buffer 36 which will bias transistors 20 and 39 into conduction. It is noted that current sink 43 operates at one-tenth of the nominal current in transistor 39 by making resistor 45 ten times the value of resistor 40. Also, diode-connected transistor 41 is made to have ten times the area of diode-connected transistor 44. Thus, the output current at terminal 25 has a maximum value of 300 times the current in sink 43. In the operating example to be given below, sink 43 was operated at about 330 microamperes which produced a maximum circuit output at terminal 25 of almost 100 ma. Clearly, the components could be ratioed at other values and other quiescent as well as maximum current values employed.

The important circuit characteristic is that it a system malfunction pulls terminal 25 down, diff-amp 38 will have its noninverting input pulled down and its output will reduce the current in source 37. This in turn will reduce the bias on the base of transistor 39 so that the emitter-base voltage on transistor 39 is held constant. This means that the lowering of the potential at terminal 25 does not result in a greater current flow in transistor 20.

As pointed out above, it is desirable for the circuit to survive output terminal fault conditions that can raise it as high as 26 volts. This will place terminal 25 about 12 volts above the $V_{CC}$ line which is nominally at 14 volts. It can be seen that this pulls the emitter of transistor 20 above its base so as to reverse bias the emitter-base junction. If it were not for the presence of transistor 21, transistor 20 would go into zener conduction which could conceivably destroy it. However, the combined zener voltages of transistors 20 and 21 exceeds the imposed 12 volts and the devices will be protected. Likewise, diode connected transistor 42 acts to protect transistor 39 from zener action when terminal 25 is raised to the 26-volt fault condition.

Figure 5:
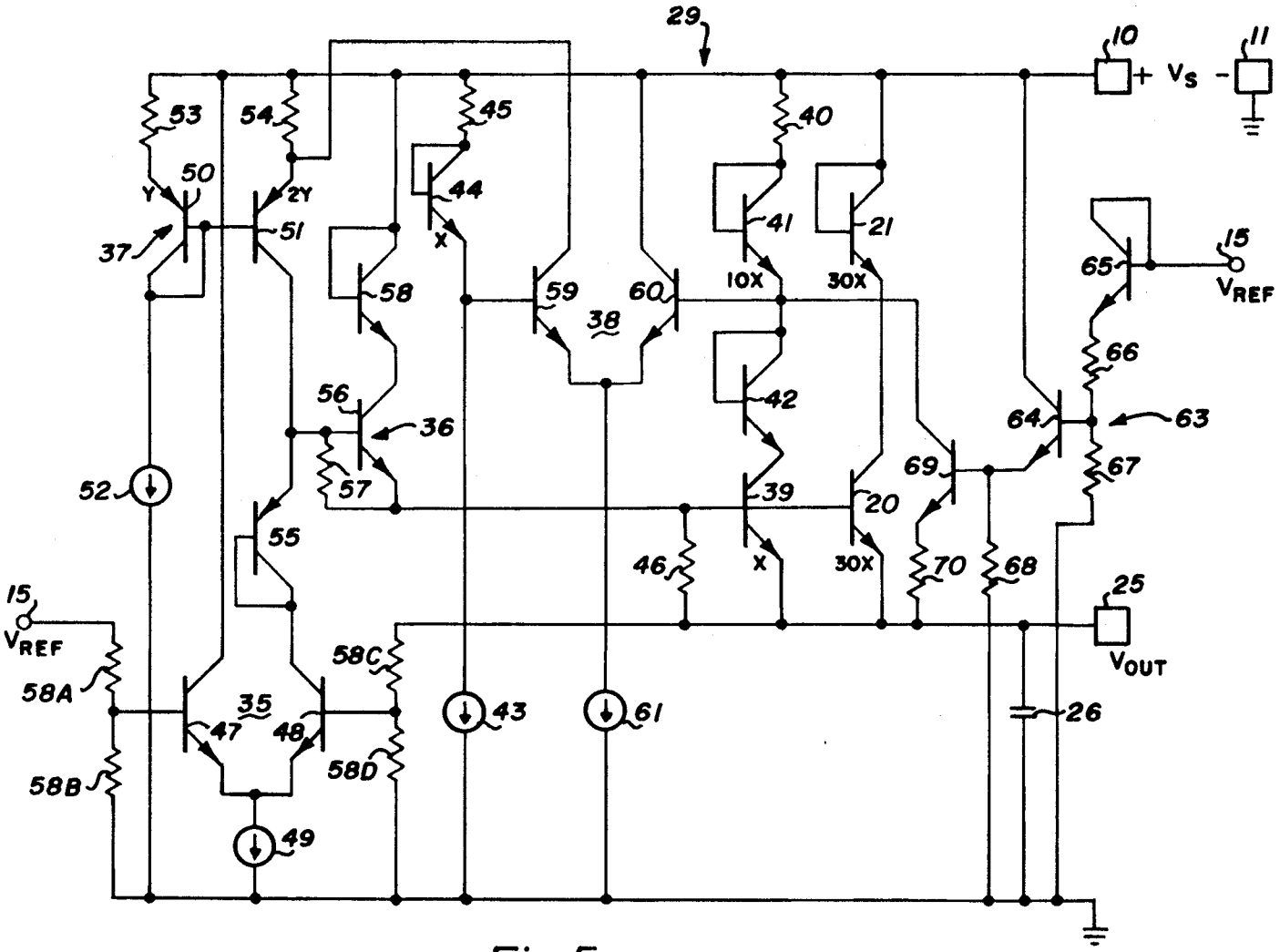
FIG. 5 is a schematic diagram of the preferred IC TPIOS circuit.

FIG. 5 is a schematic diagram of an integrated circuit preferred in performing the functions of the FIG. 4 TPIOS using conventional monolithic epitaxial PN junction isolated construction. Where the parts are the same the same numerals are used. Diff-amp 35 is composed of differentially connected transistors 47 and 48 which are supplied with a constant tail current by sink 49.

Resistors 58A, 58B, 58C and 58D comprise a pair of voltage dividers which operate the bases of transistors 47 and 48 below the $V_{REF}$ and $V_{OUT}$ levels. If these four resistors have equal values, a 2:1 divider action is present and a $V_{REF}/2$ voltage results.

Constant current source 37 is actually a current mirror composed of diode-connected input transistor 50 and output transistor 51. Thus, the current flowing in sink 52 will be reflected into the collector of transistor 48. Mirror output transistor 51 acts as the load for transistor 48. It will be noted that transistor 51 is twice the size of transistor 50. Resistors 53 and 54 act to stabilize current mirror with resistor 53 having twice the resistance of resistor 54. Thus, current mirror 37 has a stabilized current gain of two. By way of example, 150 microamperes flowing in sink 52 will cause transistor 51 to source 300 microamperes. Diode connected transistor 55 acts as an isolation element for transistor 48 and will disconnect the collector of transistor 48 when the output terminal 25 is pulled low by a fault condition. This avoids the possibility of the collector of transistor 48 acting to inject minority carriers into the IC substrate which could happen if the collector of the NPN transistor is pulled below ground.

Buffer 36 is composed of emitter follower transistor 56 which has a resistor 57 coupled in parallel with its emitter base circuit. The collector of transistor 56 is returned to the + power supply terminal 10 by diode connected transistor 58. This transistor is present to avoid zenering of transistor 56 when a system malfunction pulls output terminal to +26 volts. Thus, it is present for the same reason as transistors 21 and 42 which were described above.

It can be seen that as terminal 25 is pulled below the nominal level the pass transistor current can rise. In order to ensure that such a system malfunction will not result in an excessive current flow, a current foldback type of protection circuit 63 is incorporated into TPIOS 29.

A reference-related voltage is developed by means of a voltage divider comprised of diode-connected transistor 65 and resistors 66 and 67. Thus, the base of transistor 64 is at a positive potential. In the preferred embodiment this potential is about 4.3 volts at 300° K. Thus, the emitter of transistor 64 is at about 3.6 volts due to its emitter follower action. The potential at the emitter of transistor 64 is the potential across resistor 68 and it also biases the base of transistor 69. For normal operating conditions the emitter of transistor 69 will be at about 8 volts and it will be nonconductive. However, as a fault condition pulls terminal 25 down at some potential transistor 69 will begin to conduct and will act to pull the base of transistor 60 down. The threshold of conduction will be at an output terminal potential of about 2.9 volts. Any further drop in output voltage will result in increased conduction in transistor 69. Since the preferred value of resistor 70 is 1.4 k ohms, an output potential of about −0.2 volt will cause transistor 69 to conduct a current of 1.5 ma.

It can be seen that transistor 69 acts as a comparator. Its inverting input is operated at a reference level of about 3.6 volts and its noninverting input, which is coupled to terminal 25, will therefore have a threshold of conduction of about 2.9 volts. Its conduction at any input level will be determined by the value of resistor 70. This will result in a voltage drop in resistor 40 of about 76 millivolts which is relatively small in view of the normal 165 millivolts due to normal biasing of op-amp 38. However, any further drop in output will increase the conduction in transistor 69.

At a −4 volt fault condition the potential across resistor 70 will rise to about 6.9 volts. At this condition the current in transistor 69 will rise to about 4.9 milliamperes. This will result in a voltage drop across resistor 40 of about 245 millivolts which will dominate the nominal drop of about 165 millivolts. The feedback loop involving op-amp 38 and buffer 36, will act to reduce the conduction in transistor 20 to a very low value (less than about 20 milliamperes). At an output fault condition of zero volts at terminal 25, the current flow in transistor 20 is limited to about 40 milliamperes or less than half of the rated supply capacity. At lower terminal 25 voltages the current is reduced still further.

EXAMPLE

The circuit of the invention was constructed in the form of a monolithic IC chip breadboard using the conventional epitaxial, PN-junction-isolated, form. The NPN transistors were conventional planar devices of vertical construction. The PNP transistors were of conventional planar lateral construction. The vehicle was an automotive multiple output voltage regulator employing TPIOS circuitry. The device will be offered under the part designation LMB2003. It provides ten isolated protected outputs having a nominal 8 volts, each one of which can supply a maximum specified current of 90 milliamperes. It will be housed in a 15-lead TO-220 package.

The following chart lists the component values for the FIG. 5 circuit which constitutes the preferred embodiment of the invention:

| COMPONENT | VALUE |
|---|---|
| Capacitor 26 | 0.1 microfarad |
| Resistor 40 | 50 ohms |
| Current Sink 43 | 330 microamperes |
| Resistor 45 | 500 ohms |
| Resistors 46 and 57 | 7.5k ohms |
| Current Sink 49 | 450 microamperes |
| Current Sink 52 | 150 microamperes |
| Resistor 53 | 600 ohms |
| Resistor 54 | 300 ohms |
| Resistors 58A, B, C, D, 67 and 68 | 30k ohms |
| Current Sink 61 | 790 microamperes |
| Resistor 66 | 20k ohms |
| Resistor 70 | 1.4k ohms |

The circuit operated from a nominal 14-volt supply provided an output within the range of 7.2 to 8.5 volts. The rated output current was 100 milliamperes for each of the ten isolated outputs. The dropout voltage was $V_S-2.2$ volts. The quiescent current was less than 35 milliamperes. The load regulation was 300 millivolts over the current range of 5 to 70 milliamperes. The crosstalk between separate outputs was less than 20 millivolts when a 1000 ohm load was switched on and off to one output. The short circuit current (zero output voltage) was less than 50 milliamperes.

The invention has been described and a preferred embodiment detailed. When a person skilled in the art reads the foregoing description, alternatives and equivalents, within the spirit and intent of the invention, will be apparent. Accordingly, it is intended that the scope of the invention be limited only by the claims that follow.

We claim:

1. In a plural output voltage regulator operating from a single d-c source, wherein a single circuit provides plural regulated output voltages, and currents, which operate individually and independently from each other so as to withstand output malfunctions created by adverse load conditions such as shorting to ground or below or to a high voltage line, a plurality of transient protected isolator output stage (TPIOS) circuits, each one comprising:

an input for supplying a reference voltage to said TPIOS circuit;

an NPN output pass transistor, having emitter, base and collector electrodes, which provides one of said output voltages at its emitter;

a primary negative feedback loop which compares said output voltage with said reference voltage and drives the base of said output pass transistor whereby said output voltage is regulated; and a secondary negative feedback loop which compares a fraction of said output current with a reference current and controls the base of said output pass transistor to limit said output current to a predetermined maximum value.

2. The TPIOS circuit of claim 1 wherein said reference voltage is obtained from a constant voltage temperature insensitive source.

3. The plural output voltage regulator of claim 2 wherein said primary negative feedback loop comprises a first diff-amp having its noninverting input coupled to said reference voltage, its inverting input coupled to said output voltage and its output coupled by way of a noninverting buffer to said base of said output pass transistor.

4. The plural output voltage regulator of claim 3 wherein said first diff-amp includes a current source load.

5. The plural output voltage regulator of claim 4, wherein said secondary negative feedback loop comprises a second diff-amp having its inverting input coupled to sense a voltage representing a reference current, its noninverting input coupled to sense a voltage representing the current flow in said circuit output and its output coupled to control the current flowing in said first diff-amp load whereby said secondary negative feedback loop operates to limit said current flowing in said circuit output.

6. The plural output voltage regulator of claim 5 wherein said voltage representing the current flowing in said circuit output is developed by a small NPN transistor having an area that is ratioed to a small fraction of that of said NPN output pass transistor and has its emitter-base circuit connected in parallel with that of said NPN output pass transistor whereby said second diff-amp reference current is a small fraction of said output current and said reference current value determines the maximum circuit output current.

7. The plural output voltage regulator of claim 6 further including a current foldback circuit that comes into play when the regulated output voltage drops below a predetermined threshold, said foldback circuit comprising means for comparing said reference voltage with said circuit output voltage and passing an increasing current to said noninverting input of said second diff-amp as said regulated output voltage falls whereby a zero or negative output voltage will result in a substantial lowering of said output current in response to a system fault.

8. The plural output voltage regulator of claim 6 wherein said output pass transistor is coupled in series with a substantially identical NPN transistor diode connected and poled to forward conduct the current in said output pass transistor whereby the threshold at which said TPIOS circuit goes into zener conduction is doubled thereby increasing the maximum positive transient the circuit can tolerate at said output terminal under system malfunction conditions.

9. The plural output voltage regulator of claim 8 wherein said small NPN transistor also includes a series diode connected like-sized transistor diode having the same area and poled to forward conduct the current flowing in said small NPN transistor.

* * * * *